US010518440B2

(12) United States Patent
Kloet

(10) Patent No.: US 10,518,440 B2
(45) Date of Patent: Dec. 31, 2019

(54) PRE-STRESSED BOX CULVERT AND METHODS FOR ASSEMBLY THEREOF

(71) Applicant: LowSpan LLC, Escanaba, MI (US)

(72) Inventor: John Kloet, Escanaba, MI (US)

( * ) Notice: Subject to any disclaimer, the term of this patent is extended or adjusted under 35 U.S.C. 154(b) by 150 days.

(21) Appl. No.: 15/683,447

(22) Filed: Aug. 22, 2017

(65) Prior Publication Data

US 2018/0050467 A1 Feb. 22, 2018

Related U.S. Application Data

(60) Provisional application No. 62/377,800, filed on Aug. 22, 2016.

(51) Int. Cl.
*B28B 23/04* (2006.01)
*E01F 5/00* (2006.01)

(52) U.S. Cl.
CPC ..... *B28B 23/04* (2013.01); *E01F 5/005* (2013.01)

(58) Field of Classification Search
CPC ..... E01F 5/005; B28B 23/04; B28B 23/046; B28B 23/06; B28B 23/043
USPC ..... 405/124, 126; 264/228
See application file for complete search history.

(56) References Cited

U.S. PATENT DOCUMENTS 862,292 A * 8/1907 Stoffer ..... E04B 7/08 138/155
887,284 A * 5/1908 Stoffer ..... E01F 5/005 405/126
925,019 A * 6/1909 Parks et al. ..... E04B 7/08 138/155
928,265 A * 7/1909 Mahoney et al. ..... F16L 9/22 138/157
1,144,200 A * 6/1915 Hewett ..... E01F 5/005 138/175
1,203,768 A * 11/1916 Moore ..... E01F 5/005 138/102

(Continued)

FOREIGN PATENT DOCUMENTS

EP 0295175 A1 * 12/1988 ..... E01F 5/005
FR 1050208 A * 1/1954 ..... E01F 5/005

(Continued)

OTHER PUBLICATIONS

Translation of JPS528644 (Year: 1977).*

*Primary Examiner* — Michael Safavi
(74) *Attorney, Agent, or Firm* — McDonnell Boehnen Hulbert & Berghoff LLP

(57) ABSTRACT

A pre-stressed concrete box culvert includes a three-sided culvert top section having a pre-stressed top slab, a first sidewall and a second sidewall. The first and the second sidewalls extend orthogonally from opposite ends of the pre-stressed top slab, and the first and the second sidewalls each include a free end that has at least one male or female connector. The pre-stressed concrete box culvert includes a three-sided culvert bottom section having a pre-stressed bottom slab and a third sidewall and a fourth sidewall. The third and the fourth sidewalls extend orthogonally from opposite ends of the pre-stressed bottom slab, and the third and the fourth sidewalls each include a free end that has at least one male or female connector to mate with the at least one corresponding male or female connector arranged at one of the respective free ends of the first and the second sidewalls.

19 Claims, 6 Drawing Sheets

(56) References Cited

U.S. PATENT DOCUMENTS 1,332,387 A * 3/1920 Easterday ..... E01F 5/005 138/175
1,334,484 A * 3/1920 Charliss ..... E01F 5/005 138/158
1,361,027 A * 12/1920 Deyo ..... 138/175
1,363,056 A * 12/1920 Riedl ..... E01F 5/005 138/159
1,386,808 A * 8/1921 Stevens ..... E01F 5/005 138/102
1,408,485 A * 3/1922 Sweney ..... E01F 5/005 138/158
1,412,616 A * 4/1922 Kammerer ..... E01F 5/005 138/102
1,441,466 A * 1/1923 Wernicke ..... E01F 5/005 138/157
1,600,353 A * 9/1926 Nose ..... B28B 21/74 249/65
1,612,640 A * 12/1926 Morgan ..... E01F 5/005 138/102
1,638,428 A * 8/1927 Zander ..... E01F 5/005 138/100
1,734,392 A * 11/1929 Moore ..... E01F 5/005 138/158
1,854,815 A * 4/1932 Turner ..... F16L 9/01 138/155
1,860,533 A * 5/1932 Fredenhagen ..... F16L 9/003 138/100
1,997,236 A * 4/1935 Schroeder, Jr. ..... E01F 5/005 138/158
2,041,267 A * 5/1936 Schroeder, Jr. ..... E01F 5/005 405/125
2,236,107 A * 3/1941 Miller ..... B28B 21/72 138/176
3,269,424 A * 8/1966 Fisher ..... E01F 5/005 138/176
4,314,775 A * 2/1982 Johnson ..... F16L 1/036 138/105
4,836,714 A * 6/1989 Matiere ..... E01F 5/005 405/124
4,854,775 A * 8/1989 Lockwood ..... E01F 5/005 405/126
4,953,280 A * 9/1990 Kitzmiller ..... B28B 7/0029 249/11
4,983,070 A * 1/1991 Hwang ..... E01F 5/005 405/124
6,092,962 A * 7/2000 Lee ..... F16L 25/0018 405/126
6,203,245 B1 * 3/2001 Harten ..... E01F 5/005 138/107
6,460,213 B1 * 10/2002 Flint ..... E01F 5/005 14/73
7,770,250 B2 * 8/2010 Boresi ..... E01F 5/005 14/24
8,308,397 B2 * 11/2012 Danskine ..... B63B 5/18 114/264
8,425,153 B1 * 4/2013 South ..... E02D 29/00 405/124
2014/0137492 A1 * 5/2014 French ..... B28B 7/186 52/223.6
2016/0116112 A1 * 4/2016 Bradfield ..... E02D 29/10 52/578

FOREIGN PATENT DOCUMENTS

FR 2642109 A1 * 7/1990 ..... E01F 5/005
FR 0381547 A1 * 8/1990 ..... E01F 5/005
GB 2124277 A * 2/1984 ..... E01F 5/005
JP 52008644 A * 1/1977 ..... E03F 3/04
JP 03191137 A * 8/1991 ..... E03F 3/04

* cited by examiner

PRE-STRESSED BOX CULVERT AND METHODS FOR ASSEMBLY THEREOF

CROSS-REFERENCE TO RELATED APPLICATIONS

This application claims the benefit of priority from U.S. Provisional Application No. 62/377,800 filed Aug. 22, 2016, the disclosure of which is explicitly incorporated by reference herein in its entirety

FIELD

The present disclosure generally relates to reinforced concrete box culverts.

BACKGROUND

Concrete box culverts may be used in a variety of applications, for example, where a throughway is desired beneath a road or other embankment. Concrete box culverts are often installed supporting a roadway at stream crossings to allow the stream to flow beneath the roadway. In many cases, concrete box culverts provide a cheaper alternative that may be more easily constructed and maintained than a bridge deck that typically requires site-specific installation and design.

In some applications, a concrete box culvert may include four sides, approximating a rectangle in cross-section. In some other applications, a three-sided box culvert may be used with two sidewalls extending orthogonally from opposite ends of a top slab. The bottom ends of the two sidewalls are each typically placed on poured footings that provide a foundation to support the three-sided culvert.

Known concrete box culverts are precast using free-standing steel reinforcing bars (i.e., rebar). The maximum span of these three-sided culverts, as measured between the inside faces of the two sidewalls, is generally limited to a range of 30-35 feet. Beyond these spans, the bending moment in the middle of the top slab becomes prohibitively large.

However, in some applications, a longer span may be needed. For example, a roadway crossing may be needed for a waterway that is more than 35 feet wide. In addition, some locales may include soils with relatively low bearing capacity. In these cases, the footings needed for the placement of a three-sided box culvert (or bridge piers) may first require the installation of piles to achieve an adequate foundation. Nonetheless, in some areas, piles may be driven dozens or even hundreds of feet into the ground before the end of the pile reaches hard strata in the soil, requiring either friction piles or an alternative design.

In some of these situations, a four-sided box culvert may be contemplated that, when installed, spreads the load of the culvert across the entire bottom slab, requiring relatively less soil bearing capacity to support the culvert. Yet, a four-sided box culvert having a relatively large span, such as 40 feet, presents logistical challenges with respect to fabrication, transportation, and installation, among other considerations. This is particularly true where the design height of the box culvert between the top and bottom slabs is also relatively large, such as 10 feet or more. For these reasons, four-sided concrete box culverts of this size are generally not entertained.

SUMMARY

The apparatus and methods disclosed herein provide an improved box culvert that that may beneficially permit a relatively larger span than prior art culverts and that is practical and efficient with respect to fabrication, transportation to the job site, and installation.

In one example, a pre-stressed concrete box culvert is described including a three-sided culvert top section having a pre-stressed top slab, a first sidewall and a second sidewall. The first and the second sidewalls extend orthogonally from opposite ends of the pre-stressed top slab, and the first and the second sidewalls each include a free end that has at least one male or female connector. The pre-stressed concrete box culvert further includes a three-sided culvert bottom section having a pre-stressed bottom slab and a third sidewall and a fourth sidewall. The third and the fourth sidewalls extend orthogonally from opposite ends of the pre-stressed bottom slab, and the third and the fourth sidewalls each include a free end that has at least one male or female connector to mate with the at least one corresponding male or female connector arranged at one of the respective free ends of the first and the second sidewalls.

In another example, a method for assembling a pre-stressed concrete box culvert is described. The method includes casting a three-sided culvert top section having a pre-stressed top slab, a first sidewall and a second sidewall. The first and the second sidewalls extend orthogonally from opposite ends of the pre-stressed top slab, and the first and the second sidewalls each include a free end that has at least one male or female connector. The method further includes casting a three-sided culvert bottom section having a pre-stressed bottom slab and a third sidewall and a fourth sidewall. The third and the fourth sidewalls extend orthogonally from opposite ends of the pre-stressed bottom slab, and the third and the fourth sidewalls each include a free end that has at least one male or female connector to mate with the at least one corresponding male or female connector arranged at one of the respective free ends of the first and the second sidewalls.

In another example, a pre-stressed concrete box culvert is described including a plurality of three-sided culvert top sections each having a pre-stressed top slab, a first sidewall and a second sidewall arranged such that the first and the second sidewalls extend orthogonally from opposite ends of the pre-stressed top slab. Each of the first and the second sidewalls has a free end that has at least one male or female connector, and each of the pre-stressed top slabs of the plurality of three-sided culvert top sections has a plurality of first post-tensioning ducts extending from a first side to a second side of each pre-stressed top slab. The plurality of three-sided culvert top sections are arranged adjacent to each other such that the first plurality of post-tensioning ducts in each of the pre-stressed top slabs are aligned with each other forming a first plurality of continuous channels through the pre-stressed top slabs. The pre-stressed concrete box culvert further includes a plurality of three-sided culvert bottom sections each having a pre-stressed bottom slab, a third sidewall and a fourth sidewall arranged such that the third and the fourth sidewalls extend orthogonally from opposite ends of the pre-stressed bottom slab. Each of the third and the fourth sidewalls has a free end that has at least one male or female connector to mate with the at least one corresponding male or female connector arranged at one of the respective free ends of the first and the second sidewalls. Each of the pre-stressed bottom slabs of the plurality of the three-sided culvert bottom sections has a second plurality of post-tensioning ducts extending from a first side to a second side of each bottom slab. The plurality of three-sided culvert bottom sections are arranged adjacent to each other such that the second plurality of post-tensioning ducts in each of the pre-stressed bottom slabs are aligned with each other forming a second plurality of continuous channels through the pre-stressed bottom slabs.

The features, functions, and advantages that have been discussed can be achieved independently in various embodiments or may be combined in yet other embodiments, further details of which can be seen with reference to the following description and drawings.

BRIEF DESCRIPTION OF THE FIGURES

Examples are described below in conjunction with the appended figures, wherein like reference numerals refer to like elements in the various figures, and wherein.

DETAILED DESCRIPTION

Figure 1:
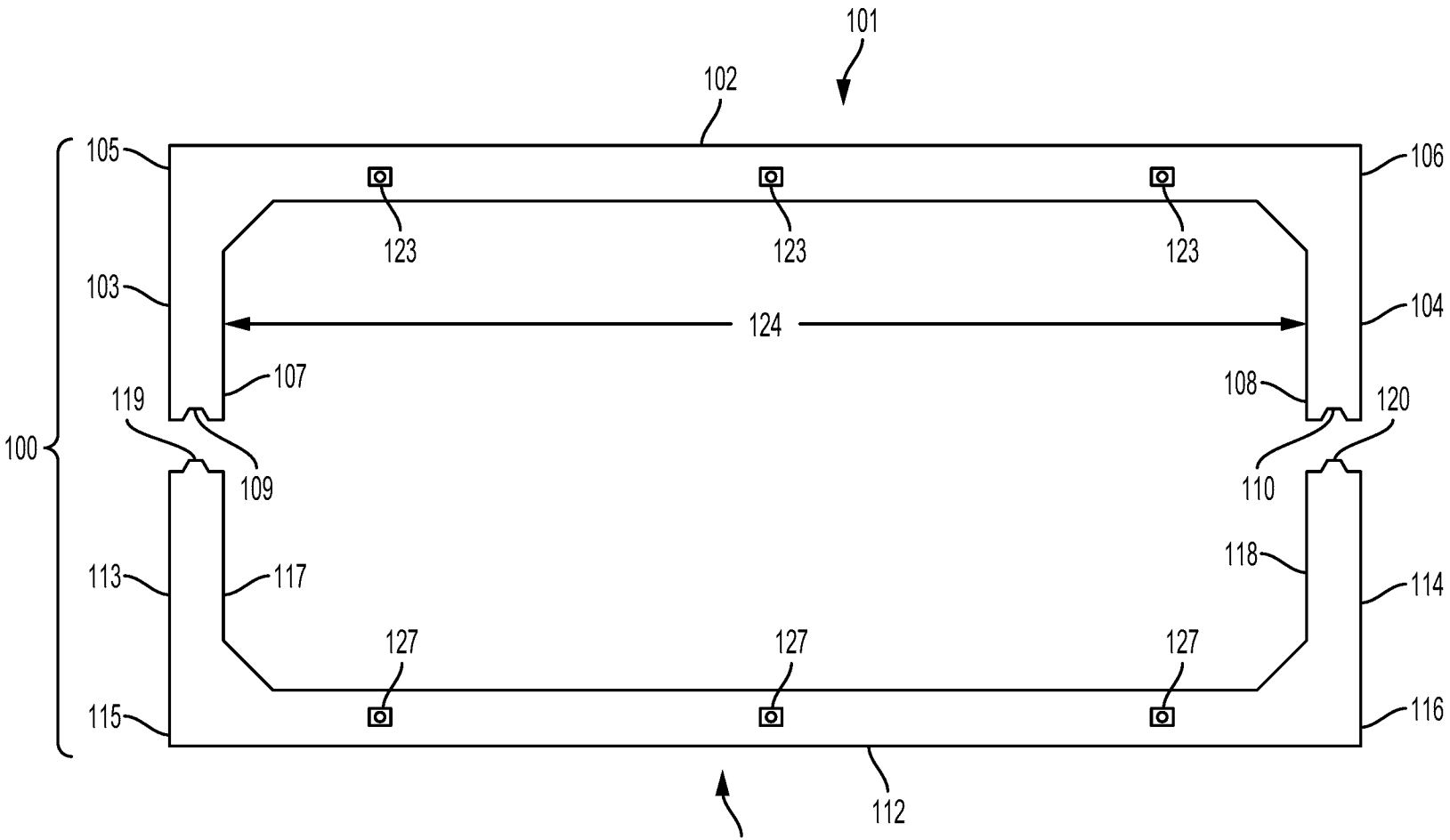
FIG. 1 illustrates a side view of a pre-stressed concrete box culvert, according to an example implementation.

Disclosed embodiments are described more fully below with reference to the accompanying Figures, in which some, but not all of the disclosed embodiments are shown. Indeed, several different embodiments may be described and should not be construed as limited to the embodiments set forth herein. Rather, these embodiments are described so that this disclosure will be thorough and complete and will fully convey the scope of the disclosure to those skilled in the art.

I. Overview

Examples discussed herein involve a four-sided box culvert that includes pre-stressing tendons in both the top and bottom slabs of the culvert. The pre-stressed concrete described herein possesses increased bending resistance and may achieve greater span lengths than a slab or a beam that includes typical free-standing concrete rebar reinforcing. The tendons may be placed in tension in a mold for the box culvert prior to the concrete being cast. Once the concrete has cured in the mold and around the tendons, the tension may be removed and the tendons will thereby compress the top and bottoms slabs of the culvert. For example, a concrete box culvert that includes pre-stressed top and bottom slabs may reach spans up to 60 feet. However, pre-stressing the top and bottom slabs to achieve greater spans may lead to culvert geometries that are challenging to fabricate and impractical to transport.

Therefore, the four-sided box culvert contemplated herein may include two separate, three-sided box culvert sections. The two sections may then be joined by first installing one three-sided bottom section slab-side down with the two sidewalls extending upward, with the free ends of each sidewall having a male or female connector. The other three-sided top section may then be placed with slab-side up, with the two sidewalls extending downward such that corresponding male or female connectors mate with the respective sidewalls of the bottom section. In this way, the four-sided, pre-stressed concrete box culvert contemplated herein may achieve relatively large dimensions by dividing the box culvert into two parts for later assembly in the field, making both fabrication and transportation easier.

Depending on the width of the crossing for which the culvert is needed, several pairs of top and bottom culvert sections may be placed adjacent to one another in series until enough sections are provided for a given crossing. In some cases, for example, where the soils have low bearing capacity, mechanically tying the culvert sections together may be desirable in order to minimize differential settlement between adjacent culvert sections. Thus, a plurality of longitudinal post-tensioning ducts may be provided in both the pre-stressed top and bottom slabs of an example box culvert. These ducts in the form of longitudinal tubes may be placed in the mold such that the concrete may cure around the ducts. Other possibilities for forming the ducts also exist. Each duct may be aligned with those of adjacent culvert sections, such that the post-tensioning ducts are continuously aligned through the series of adjacent top and bottom culvert sections. Accordingly, post-tensioning tendons may be inserted into each of the ducts, and an anchor plate attached to the tendons at each end of the culvert. These may be used to compress the adjacent culvert sections together by applying tension to the tendon. Other examples are also possible, including some implementations where the adjacent culvert sections are not mechanically tied together.

Further, the opposing top and bottom culvert sections may be mechanically tied together as well. For example, a bracket or other fastener may be attached to the exterior of the culvert and may tie the top and bottom sections together. In other examples, the top section may be installed on top of the bottom section with no further mechanical fastener. In this example, a grout or other known sealant may be poured into the joint to maintain the connection. In various other embodiments, mating of the male and female connectors of the sidewalls of the respective top and bottom sections in combination with the weight of the top section may be sufficient to operatively couple the top and bottom sections together. Other possibilities exist.

In some implementations, the top section and the bottom section may have similar or even identical dimensions, having top and bottom slabs with the same thickness, and sidewalls of the same height. In other examples, the sidewalls of the top section may have a different height than the sidewalls of the bottom section. Further, the pre-stressed box culverts disclosed herein are not limited to applications requiring a large span. For example, pre-stressing the top and bottom slabs of the culvert may allow for a relatively thinner slab than typical rebar reinforcement presently permits. Therefore, a pre-stressed concrete box culvert may be desirable where site conditions limit the span and height of the culvert, yet the end area of the culvert (i.e., the span times the height) must be maximized. In addition, the example culverts discussed herein are also not limited in their use to low-bearing capacity soils.

By the term "about" or "substantial" and "substantially" or "approximately," with reference to amounts or measurement values, it is meant that the recited characteristic, parameter, or value need not be achieved exactly. Rather, deviations or variations, including, for example, tolerances, measurement error, measurement accuracy limitations, and other factors known to those skilled in the art, may occur in amounts that do not preclude the effect that the characteristic was intended to provide.

II. Example Pre-Stressed Box Culverts

Referring now to FIG. 1, a partially exploded view of a pre-stressed concrete box culvert 100 (hereinafter, the culvert 100) is shown, according to an example implementation. The culvert 100 includes a three-sided culvert top section 101 having a pre-stressed top slab 102, representing the top of the culvert 100. The three-sided culvert top section 101 also includes a first sidewall 103 and a second sidewall 104. The first and second sidewalls 103, 104 extend orthogonally from opposite ends, 105 and 106, respectively, of the pre-stressed top slab 102.

The first and second sidewalls 103, 104 each include a free end 107, 108 that has at least one male or female connector. For instance, as shown in FIG. 1, the first sidewall 103 may include a free end 107, which includes a female connector 109. In this example, the female connector 109 is a trapezoidal-shaped groove in the free end 107, although other polygonal or circular shapes are contemplated. Similarly, the second sidewall 104 shown in FIG. 1 includes a free end 108 that also includes a female connector 110.

The culvert 100 further includes a three-sided culvert bottom section 111, positioned below the three-sided culvert top section 101. The three-sided culvert bottom section 111 includes a pre-stressed bottom slab 112, representing the bottom of the culvert 100, as well as a third sidewall 113 and a fourth sidewall 114. The third and the fourth sidewalls 113, 114 extend orthogonally from opposite ends, 115 and 116, respectively, of the pre-stressed bottom slab 111.

Similar to the first and second sidewalls 105, 106 discussed above, the third and fourth sidewalls 115, 116 each include a free end that has at least one male or female connector arranged to mate with the at least one corresponding male or female connector at one of the respective free ends of the first and the second sidewalls 105, 106. As shown in FIG. 1, the third sidewall 113 may include a free end 117 that includes a male connector 109 arranged to mate with the corresponding female connector 109 on the free end 107 of the first sidewall 103. Similarly, the fourth sidewall 114 may include a free end 118 that includes a male connector 120 arranged to mate with the corresponding female connector 110 on the free end 108 of the second sidewall 104. The male connectors 119, 120 may be a trapezoidal-shaped protrusions sized to engage the similarly shaped grooves of the female connectors 109, 110 or any other polygonal or circular shape that corresponds to the respective female connectors 109, 110.

Accordingly, the three-sided culvert top section 101 may be positioned atop the three-sided culvert bottom section 111 such that the top slab 102 is arranged opposite the bottom slab 112. Further, the at least one male or female connector 109, 110 of each free end 107, 108 of the first and the second sidewalls 103, 104 is mated with the at least one corresponding male or female connector 119, 120 of the respective free end 117, 118 of the third and the fourth sidewalls 113, 114.

In some implementations, a grout may be poured into the joint between the male and female coupling parts to complete the connection and help distribute the load between the first and second three-sided culvert sections 101, 111 more evenly. In some cases, shims may also be used within the joint, to reduce concrete point loads that are present due to imperfections in fabrication. Grout may then be poured into the joint around the shims. Sealing strips and the like for use in concrete joints, among other examples, are also possible.

In the example shown in FIG. 1, the three-sided culvert top section 101, positioned on the top of the assembly, includes female coupling parts 109, 110, and the three-sided culvert bottom section 111, positioned on the bottom of the assembly, includes male coupling parts 119, 120. However, this arrangement could easily be reversed, wherein the three-sided culvert top section 101 includes male coupling parts, and the three-sided culvert bottom section 111 includes male coupling parts.

In the example shown in FIG. 1, both the top and bottom three-sided culvert sections 101, 111 are symmetric from left to right. In such an implementation, there may be no difference between the first sidewall 103 being mated with the third sidewall 113, as shown in FIG. 1, or with the fourth sidewall 114. In other words, the horizontal orientation of the first and second three-sided culvert sections 101, 111 may be reversible when they are joined.

However, in other examples, the first and three-sided culvert bottom section 101, 111 may need to be joined in a particular configuration. For example, the culvert 100 may be installed adjacent to a structure or other feature that requires adjustments to be made in the fabrication of the sidewalls on that particular side of the culvert 100. For example, the sidewalls may include additional rebar that protrudes from only one side of the culvert 100, to be used for tying the culvert to the adjacent structure. As another example, the design loading conditions for the culvert 100 may dictate that one sidewall of the culvert 100 include more reinforcing steel than the opposite sidewall. In this situation, it may not be readily apparent by viewing a fully fabricated, three-sided culvert section which sidewall is which. Other possibilities also exist that may dictate the fabrication and installation of a culvert 100 that is not designed symmetrically from left to right.

In these situations, it may be desirable to form both the three-sided culvert top and bottom sections 101, 111 with a male connector at the free end of one sidewall and a female connector at the free end of the opposite sidewall. In this arrangement, the three-sided culvert top and bottom sections 101, 111 are no longer reversible, and can only be joined in one configuration where the sidewall connectors will meet male-female and female-male. This may help to increase the likelihood of a proper installation in the correct orientation of the culvert 100 in the field.

As mentioned above, the culvert 100 may be fabricated in spans that are generally larger than those that are possible with other culvert designs. For example, the culvert 100 may include a span 124 between inside faces of the first and second sidewalls 103, 104 that is at least 40 feet. In other examples, the span 124 may be greater, reaching lengths of at least 55 feet. In some further implementations, spans of up to 80 feet or more for the culvert 100 may be possible.

Figure 2:
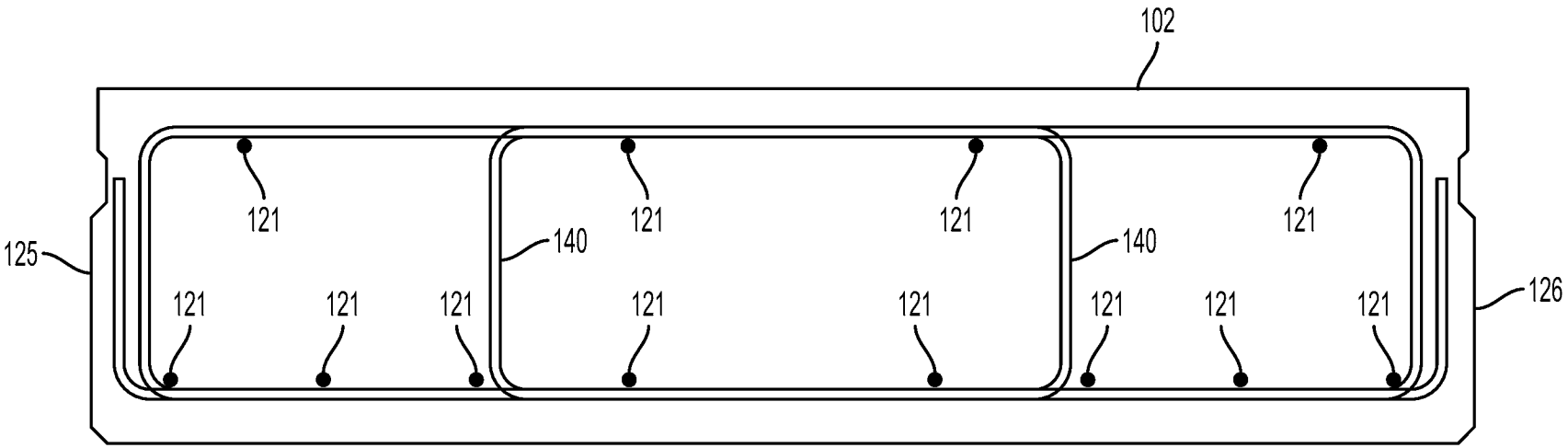
FIG. 2 illustrates cross sectional view of a top slab of a pre-stressed concrete box culvert, according to an example implementation.

FIG. 2 shows a cross sectional view of the top slab 102 of the culvert 100, according to an example implementation. For example, the top slab 102 may include a first plurality of steel tendons 121 extending between the opposite ends 105, 106 of the top slab 102 and applying a compressive force to the top slab 102. The number and spacing of the steel tendons 121 between the first side 125 and the second side 126 of the top slab 102 may vary depending on the design loading conditions for the culvert 100, and the arrangement shown in FIG. 2 represents only one example. Further, the top slab 102 may also include other steel reinforcement that is not pre-stressed, such as stirrups 140 for providing increased shear strength. Additional reinforcing bars may also be included at the junction of the sidewalls 130, 104 and the top slab 102.

Similarly, the bottom slab 112 may include a second plurality of steel tendons 122 extending between the opposite ends 115, 116 of the bottom slab 111 and applying a compressive force to the bottom slab 102. The cross section of the bottom slab 112 may be similar in design and appearance to the cross section of the top section 102 shown in FIG. 2, although the bottom slab 102 may require a different number and spacing of steel tendons 122 than the top slab 102, depending on the particular design considerations.

In some examples, the three-sided culvert top and bottom sections 101, 111 discussed above may be fabricated in a plurality of sections that have a uniform width, such as six feet. These sections may then be placed adjacent to one another in series until enough sections are provided for a given crossing. For example, a typical two lane roadway, including shoulders and guardrails on either side, may be approximately 30 feet wide. Thus, a total of five (5) six-foot wide, three-sided culvert bottom sections 111 may be installed adjacent to one another in series forming a bottom half of the culvert 100. Another five (5) six-foot wide, three-sided culvert top sections 101 may be installed atop the bottom sections 111, forming a top half of the culvert 100 to provide a crossing for the roadway.

Figure 3:
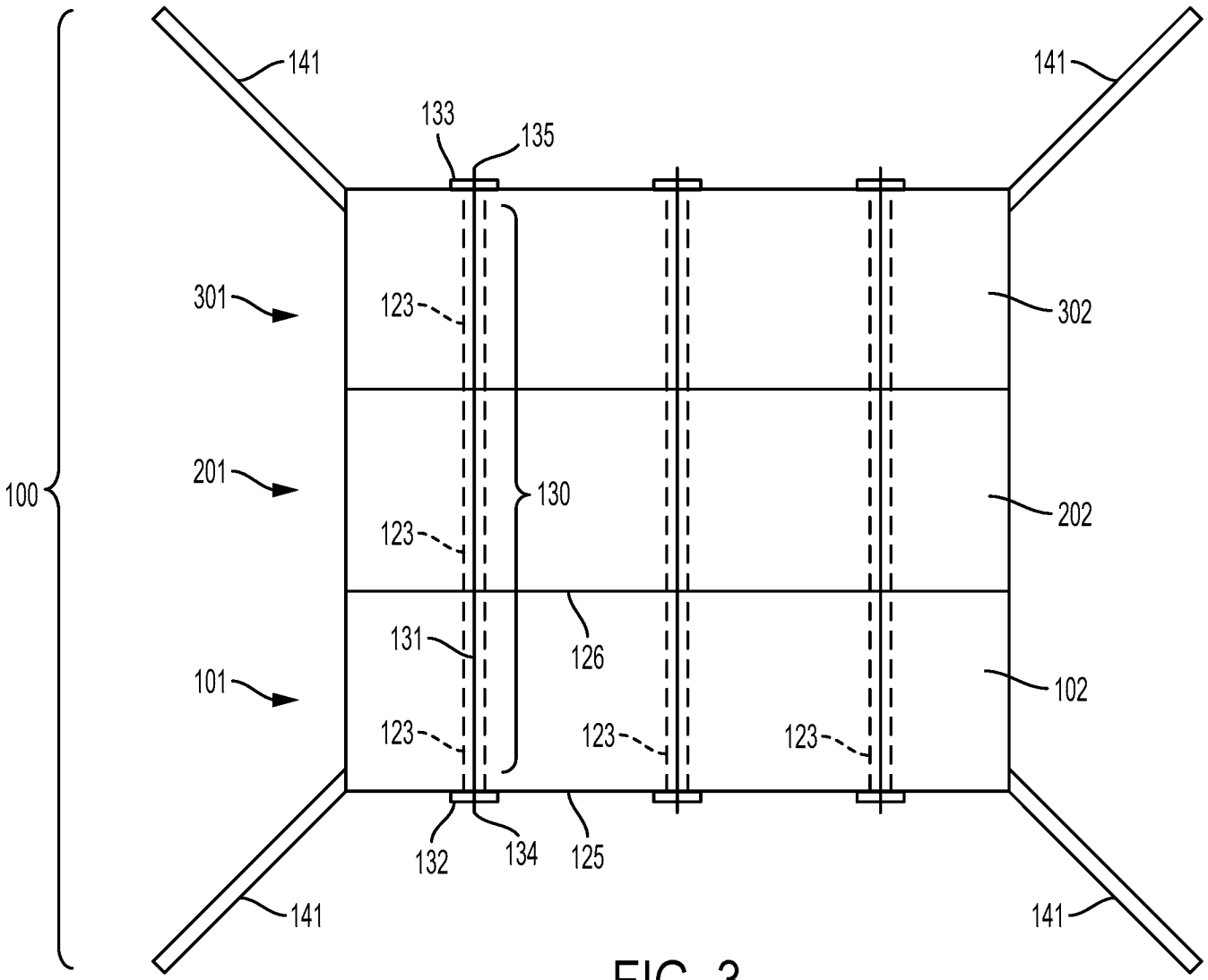
FIG. 3 illustrates a top view of a pre-stressed concrete box culvert, according to an example implementation.

FIG. 3 illustrates a top view of a pre-stressed concrete box culvert, according to an example implementation. FIG. 3 shows three adjacent three-sided culvert top sections 101, 201, 301 forming the top half of the culvert 100. Accordingly, the top slabs 102, 202, 302 of each can be seen. The corresponding culvert bottom sections cannot be seen in FIG. 3. FIG. 3 also shows headwalls 141 at the ends of the culvert 100.

The three adjacent three-sided culvert top sections 101, 201, 301 may be similar in design. For instance, the top slab 102 of the three-sided culvert top section 101 may include a first plurality of post-tensioning ducts 123, shown in dashed lines in FIG. 3, extending from a first side 125 to a second side 126 of the pre-stressed top slab 102. Further, the adjacent top slabs 202 and 303 may include similar post-tensioning ducts 123.

Moreover, the plurality of three-sided culvert top sections 101, 201, 301 may be arranged adjacent to each other such that the first plurality of post-tensioning ducts 123 in each of the pre-stressed top slabs 102, 202, 302 are aligned with each other, forming a first plurality of continuous channels 130 through the pre-stressed top slabs 102, 202, 302. Further, at least one post-tensioning tendon 131 may be disposed in one of the first plurality of continuous channels 130 through the pre-stressed top slabs 102, 202, 302. A jacking mechanism may then apply tension to the post-tensioning tendon 131, and the post-tensioning tendon 131 may then be secured at its ends to the top slabs 102, 202, 302, providing a compressive force to urge the plurality of three-sided culvert top sections 101, 201, 301 together. For example, a first anchor plate 132 and a second anchor plate 133 may each be coupled to opposite ends 134, 135 of the at least one post-tensioning tendon 131.

Although the corresponding three-sided culvert bottom sections cannot be seen in FIG. 3, they may include similar or identical features as those shown in FIG. 3. For example, the pre-stressed bottom slab 102 may include a second plurality of post-tensioning ducts 127 (seen in FIG. 1) extending from a first side 128 to a second side 129 (seen in FIG. 4) of the pre-stressed bottom slab 102. Further, each of the pre-stressed bottom slabs of the plurality of the three-sided culvert bottom sections may include a plurality of post-tensioning ducts 127 extending from a first side to a second side of each bottom slab. The plurality of three-sided culvert bottom sections may be arranged adjacent to each other such that the second plurality of post-tensioning ducts 127 in each of the pre-stressed bottom slabs are aligned with each other, forming a second plurality of continuous channels through the pre-stressed bottom slabs.

As discussed above in relation to the top slabs, at least one post-tensioning tendon may be disposed in one of the second plurality of continuous channels through the pre-stressed bottom slabs. Further, a third anchor plate and a fourth anchor plate may each be coupled to opposite ends of the at least one post-tensioning tendon disposed in one of the second plurality of continuous channels through the pre-stressed bottom slabs.

Figure 4:
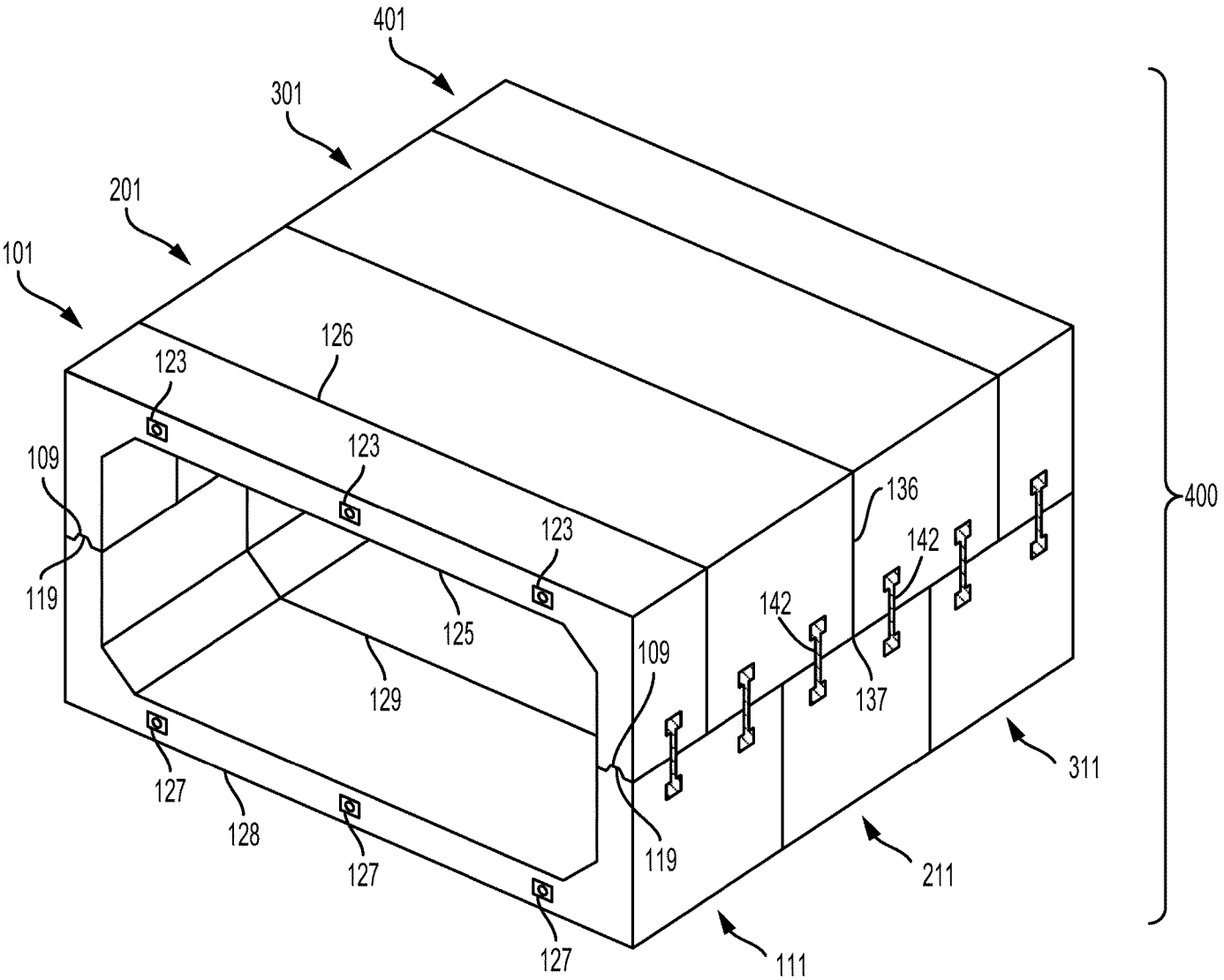
FIG. 4 illustrates a perspective view of a pre-stressed concrete box culvert, according to an example implementation.

FIG. 4 illustrates a perspective view of a pre-stressed concrete box culvert 400, according to another example implementation. In some examples, as shown in FIG. 4, it may be desirable to stagger the location of the joints between adjacent top and bottom sections of the culvert 400. For instance, each joint 136 between adjacent three-sided culvert top sections 101, 201, 301, 401 may be positioned such that the joint is approximately aligned with a center 137 of one of the three-sided culvert bottom sections 111, 211, 311. This may result in a joint pattern on the exterior of the culvert 400 that is similar to the consecutive rows in a brick wall. Further, this may require the end-most three-sided culvert top sections 101, 401 to be fabricated at half the width of the other top sections 201, 301, in order for the joints to align properly. Other arrangements are also possible.

In some implementations, it may be desirable to mechanically tie the top and bottom culvert sections together with a bracket, connector, or other type of fastener. For example, the culvert 100 may include at least one fastener 142 attached to both the three-sided culvert top section 101 and the three-sided culvert bottom section 111 such that the three-sided culvert top section 101 and the three-sided culvert bottom section 111 are tied together. With respect to the culvert 400, some of the three-sided culvert top sections, such as top section 201, may be positioned atop two adjacent three-sided culvert bottom sections 111 and 211. In this example, the culvert top section 201 may have two fasteners 142 attached to it, with each fastener 142 attached to one of the respective bottom sections 111, 211.

In some examples, the sidewalls of each respective top and bottom section may be cast with a portion of each fastener included. During installation, these pre-installed portions of each fastener may be joined by a steel rod or other connector, among other examples. Additionally or alternatively, a fastener may be drilled and grouted into the top and bottom sections, post-fabrication. Numerous other possibilities exist.

III. Example Assembly of Pre-Stressed Box Culverts

Figure 5:
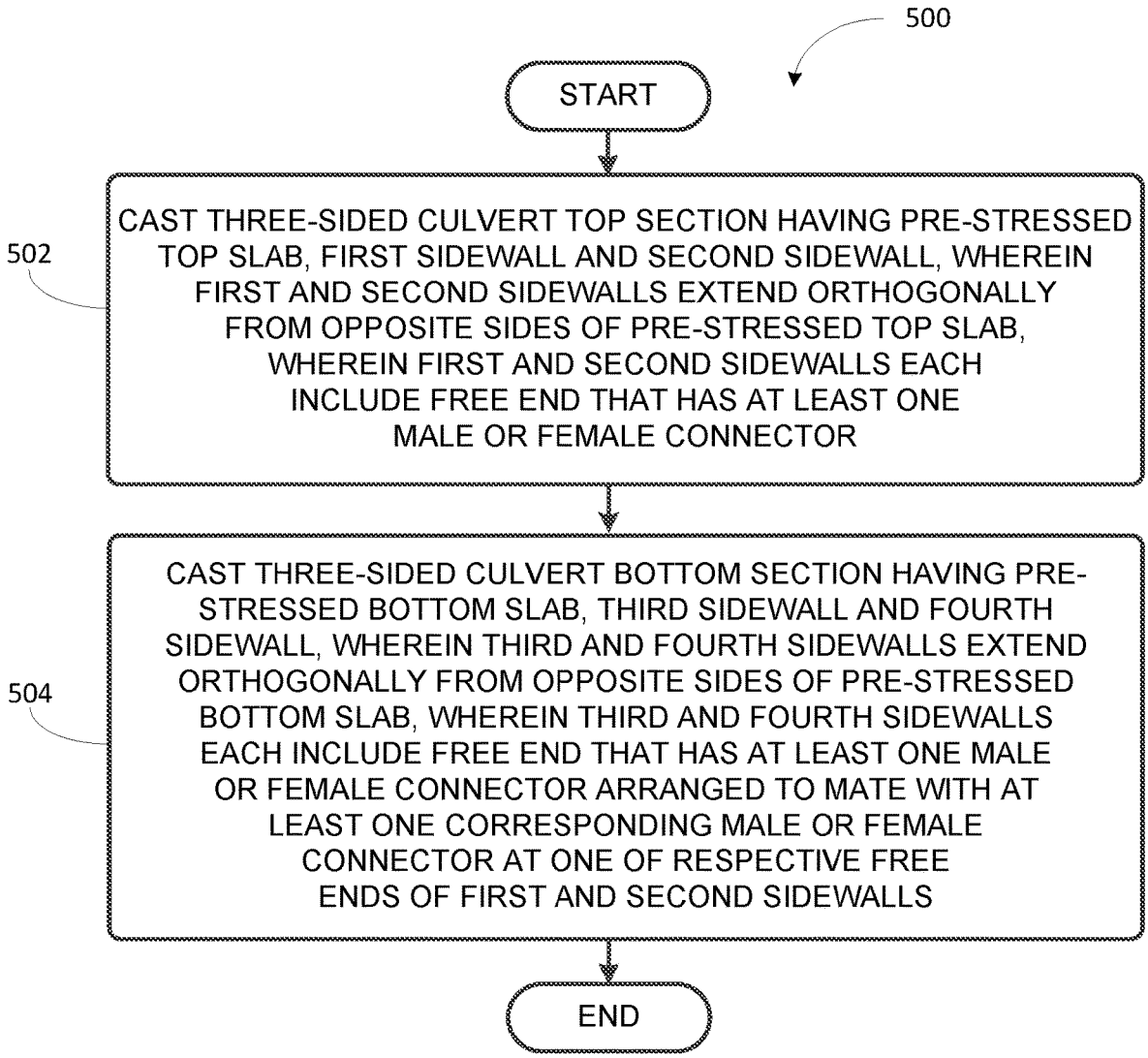
FIG. 5 shows a flowchart of an example method for assembling a pre-stressed concrete box culvert.

FIG. 5 shows a flowchart of an example method 500 for assembling a pre-stressed concrete box culvert. Method 500 shown in FIG. 5 presents an embodiment of a method that, for example, could be used to assemble the pre-stressed concrete box culvert 100 shown in FIGS. 1-3, or the pre-stressed concrete box culvert 400 of FIG. 4. It should be understood that for this and other processes and methods disclosed herein, flowcharts show steps and operation of one possible implementation of present embodiments. Alternative implementations are included within the scope of the example embodiments of the present disclosure, in which steps may be executed out of order from that shown or discussed, including substantially concurrently, depending on the steps involved, as would be understood by those reasonably skilled in the art.

At block 502, the method 500 includes casting a three-sided culvert top section having a pre-stressed top slab, a first sidewall and a second sidewall. For example, the three-sided culvert top section may be the three-sided culvert top section 101 shown in FIG. 1, having top slab 102, first sidewall 103 and second sidewall 104. As discussed above, the first and the second sidewalls 103, 104 extend orthogonally from opposite ends 105, 106 of the pre-stressed top slab 102, and the first and the second sidewalls 103, 104 each include a free end 107, 108 that has at least one male or female connector. In the case of the three-sided culvert top section 101, the free ends 107, 108 each include a female connector 109, 110.

At block 504, the method 500 includes casting a three-sided culvert bottom section having a pre-stressed bottom slab and a third sidewall and a fourth sidewall. For example, the three-sided culvert bottom section may be the three-sided culvert bottom section 111 shown in FIG. 1, having bottom slab 112, first sidewall 113 and second sidewall 114. As discussed above, the third and the fourth sidewalls 113, 114 extend orthogonally from opposite ends 115, 116 of the pre-stressed bottom slab 112. The third and the fourth sidewalls 113, 114 each include a free end 117, 118 that has at least one male or female connector arranged to mate with the at least one corresponding male or female connector at one of the respective free ends of the first and the second sidewalls 103, 104. As noted above, the free ends 117, 118 each include a male connector 119, 120 arranged to mate with the corresponding female connectors 109, 110.

The method 500 may further include arranging a first plurality of steel tendons 121 to extend between opposite ends of a mold for the top slab 102 of the three-sided culvert top section 101, and then placing the first plurality of steel tendons 121 under tension prior to concrete curing in the mold. Similarly, the method 500 may include arranging a second plurality of steel tendons 122 to extend between opposite ends of a mold for the bottom slab 112 of the three-sided culvert bottom section 111, and placing the second plurality of steel tendons 122 under tension prior to concrete curing in the mold.

Figure 6:
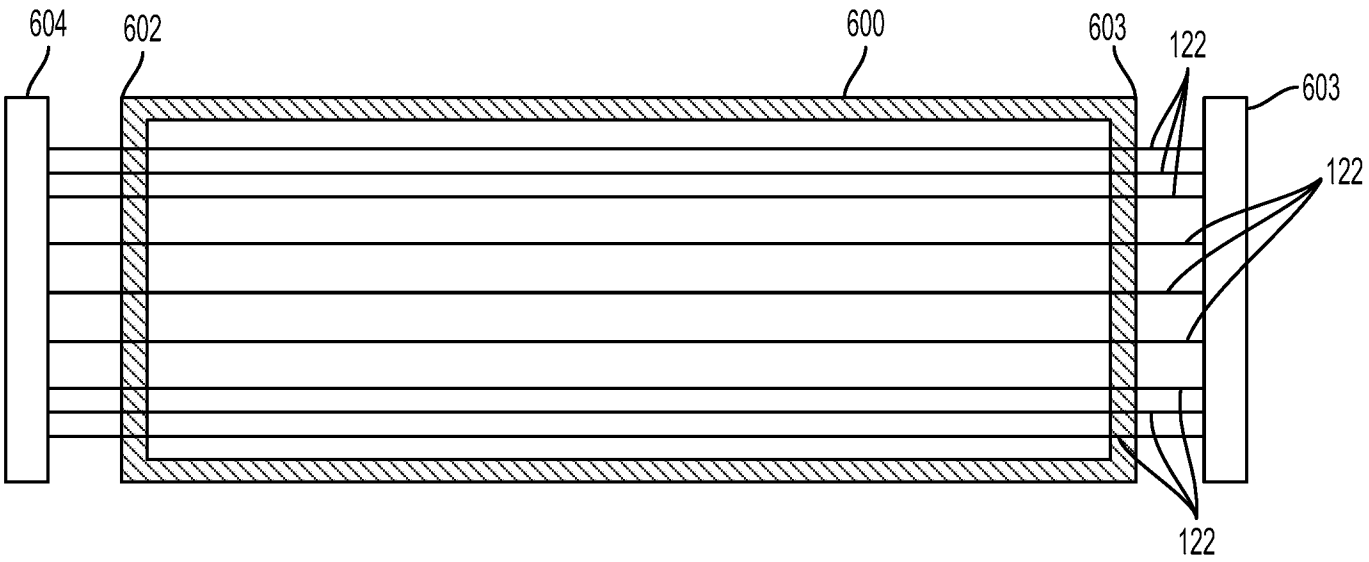
FIG. 6 illustrates a mold for the assembly of a pre-stressed concrete box culvert, according to an example implementation.

FIG. 6 illustrates a mold 600 for the assembly of a pre-stressed concrete box culvert, according to an example implementation. In FIG. 6, the second plurality of steel tendons 122 are arranged to extend between the opposite ends 601 and 602 of the mold 600. Tension may be applied to the plurality of steel tendons 122 by securing one end of the tendons to an anchor 603, and then applying a tensile force to the other end of the tendons with a jacking mechanism 604. Other arrangements for pre-tensioning the plurality of steel tendons 122 are also possible. Further, the first plurality of steel tendons 121 for the top slab 102 could be arranged and tensioned in a similar fashion.

In addition the pre-tensioned steel tendons, other steel reinforcing as discussed above, may be added to the mold prior to pouring concrete into the mold. Further, because it may be desirable to integrally cast the top and bottom slabs with their respective sidewalls in a single pour, the mold 600 may include vertically extending walls (not shown) to provide forms for the sidewalls.

As noted above, the culvert 100 may have a relatively large span, and thus the mold 600 may be equally long. For example, casting the three-sided culvert top section 101 may include casting the pre-stressed top slab 102, the first sidewall 103, and the second sidewall 104 such that a span 124 between inside faces of the first and the second sidewalls 103, 103 is at least 40 feet. Consequently, the length between the first end 601 and the second end 602 of the mold may also be at least 40 feet.

After the three-sided culvert top section 101 and the three-sided culvert bottom section 111 are cast, the method 500 may further include positioning the three-sided culvert top section 101 atop the three-sided culvert bottom section 111 as discussed above, such that the corresponding male and female connectors are appropriately mated.

In some implementations, casting the three-sided culvert top section 101 may include casting the pre-stressed top slab 102 to include a first plurality of post-tensioning ducts 123 extending from a first side 125 to a second side 126 of the pre-stressed top slab 102, as discussed above and shown in FIG. 3. Similarly, casting the three-sided culvert bottom section 111 may include casting the pre-stressed bottom slab 112 to include a second plurality of post-tensioning ducts 127 extending from a first side 128 to a second side 129 of the pre-stressed bottom slab 112, as shown in FIG. 4.

As discussed above, a plurality of three-sided culvert top sections may be arranged adjacent to one another such that the post-tensioning ducts 123 are aligned, and form a continuous channel 130 through the pre-stressed top slabs, as shown in FIG. 3. Accordingly, the method 500 may include placing at least one post-tensioning tendon 131 through at least one of the first plurality of continuous channels 130, and compressing the plurality of adjacent three-sided culvert top sections by applying tension to the at least one post-tensioning tendon 131. A first anchor plate 132 and a second anchor plate 133 may then be coupled to opposite ends 134, 135 of the post tensioning tendon 131. A similar process may be following for the corresponding plurality of three-sided culvert bottom sections.

As shown in FIG. 4 and discussed above, the method 500 may further include attaching a fastener 142 to both the three-sided culvert top section 101 and the three-sided culvert bottom section 111 such that the three-sided culvert top section 101 and the three-sided culvert bottom section 111 are tied together.

The description of the different advantageous arrangements has been presented for purposes of illustration and description, and is not intended to be exhaustive or limited to the embodiments in the form disclosed. Many modifications and variations will be apparent to those of ordinary skill in the art. Further, different advantageous embodiments may describe different advantages as compared to other advantageous embodiments. The embodiment or embodiments selected are chosen and described in order to explain the principles of the embodiments, the practical application, and to enable others of ordinary skill in the art to understand the disclosure for various embodiments with various modifications as are suited to the particular use contemplated.

What is claimed is:

1. A pre-stressed concrete box culvert comprising:

a three-sided culvert top section having a pre-stressed top slab, a first sidewall and a second sidewall, wherein the first and the second sidewalls extend orthogonally from opposite ends of the pre-stressed top slab, wherein the pre-stressed top slab has a first plurality of steel tendons extending between the opposite ends of the pre-stressed top slab and applying a compressive force to the pre-stressed top slab, and wherein the first and the second sidewalls each include a free end that has at least one male or female connector; and a three-sided culvert bottom section having a pre-stressed bottom slab and a third sidewall and a fourth sidewall, wherein the third and the fourth sidewalls extend orthogonally from opposite ends of the pre-stressed bottom slab, wherein the pre-stressed bottom slab has a second plurality of steel tendons extending between the opposite ends of the pre-stressed bottom slab and applying a compressive force to the pre-stressed bottom slab, and wherein the third and the fourth sidewalls each include a free end that has at least one male or female connector arranged to mate with the at least one corresponding male or female connector at one of the respective free ends of the first and the second sidewalls.

2. The pre-stressed concrete box culvert of claim 1, wherein the three-sided culvert top section is positioned atop the three-sided culvert bottom section such that the pre-stressed top slab is arranged opposite the pre-stressed bottom slab and wherein the at least one male or female connector of each free end of the first and the second sidewalls is mated with the at least one corresponding male or female connector of the respective free end of the third and the fourth sidewalls.

3. The pre-stressed concrete box culvert of claim 2, wherein a span between inside faces of the first and the second sidewalls is at least 40 feet.

4. The pre-stressed concrete box culvert of claim 2, wherein a span between inside faces of the first and the second sidewalls is at least 55 feet.

5. The pre-stressed concrete box culvert of claim 2, further comprising at least one fastener attached to both the three-sided culvert top section and the three-sided culvert bottom section such that the three-sided culvert top section and the three-sided culvert bottom section are tied together.

6. The pre-stressed concrete box culvert of claim 1, wherein the pre-stressed top slab comprises a first plurality of post-tensioning ducts extending from a first side to a second side of the pre-stressed top slab, and wherein the pre-stressed bottom slab comprises a second plurality of post-tensioning ducts extending from a first side to a second side of the pre-stressed bottom slab.

7. A method for assembling a pre-stressed concrete box culvert comprising:

casting a three-sided culvert top section having a pre-stressed top slab, a first sidewall and a second sidewall, wherein the first and the second sidewalls extend orthogonally from opposite ends of the pre-stressed top slab, wherein the pre-stressed top slab has a first plurality of steel tendons extending between the opposite ends of the pre-stressed top slab and applying a compressive force to the pre-stressed top slab, and wherein the first and the second sidewalls each include a free end that has at least one male or female connector; and casting a three-sided culvert bottom section having a pre-stressed bottom slab and a third sidewall and a fourth sidewall, wherein the third and the fourth sidewalls extend orthogonally from opposite ends of the pre-stressed bottom slab, wherein the pre-stressed bottom slab has a second plurality of steel tendons extending between the opposite ends of the pre-stressed bottom slab and applying a compressive force to the pre-stressed bottom slab, and wherein the third and the fourth sidewalls each include a free end that has at least one male or female connector arranged to mate with the at least one corresponding male or female connector at one of the respective free ends of the first and the second sidewalls.

8. The method of claim 7, further comprising:

positioning the three-sided culvert top section atop the three-sided culvert bottom section such that the pre-stressed top slab is arranged opposite the pre-stressed bottom slab and wherein the at least one male or female connector of each free end of the first and the second sidewalls is mated with the at least one corresponding male or female connector of the respective free end of the third and the fourth sidewalls.

9. The method claim 8, wherein casting the three-sided culvert top section comprises casting the pre-stressed top slab, the first sidewall, and the second sidewall such that a span between inside faces of the first and the second sidewalls is at least 40 feet.

10. The method claim 8, further comprising:

attaching a fastener to both the three-sided culvert top section and the three-sided culvert bottom section such that the three-sided culvert top section and the three-sided culvert bottom section are tied together.

11. The method of claim 8, further comprising arranging a first plurality of steel tendons to extend between opposite ends of a mold for the pre-stressed top slab of the three-sided culvert top section;

placing the first plurality of steel tendons under tension prior to concrete curing in the mold;

arranging a second plurality of steel tendons to extend between opposite ends of a mold for the bottom slab of the three-sided culvert bottom section; and placing the second plurality of steel tendons under tension prior to concrete curing in the mold.

12. The method of claim 11, wherein casting the three-sided culvert top section comprises casting the pre-stressed top slab to include a first plurality of post-tensioning ducts extending from a first side to a second side of the pre-stressed top slab, and wherein casting the three-sided culvert bottom section comprises casting the pre-stressed bottom slab to include a second plurality of post-tensioning ducts extending from a first side to a second side of the pre-stressed bottom slab.

13. A pre-stressed concrete box culvert comprising:

a plurality of three-sided culvert top sections each having a pre-stressed top slab, a first sidewall and a second sidewall arranged such that the first and the second sidewalls extend orthogonally from opposite ends of the pre-stressed top slab, wherein the pre-stressed top slab has a first plurality of steel tendons extending between the opposite ends of the pre-stressed top slab and applying a compressive force to the pre-stressed top slab, wherein each of the first and the second sidewalls has a free end that has at least one male or female connector, wherein each of the pre-stressed top slabs of the plurality of three-sided culvert top sections comprises a plurality of post-tensioning ducts extending from a first side to a second side of each pre-stressed top slab, and wherein the plurality of three-sided culvert top sections are arranged adjacent to each other such that the first plurality of post-tensioning ducts in each of the pre-stressed top slabs are aligned with each other forming a first plurality of continuous channels through the pre-stressed top slabs; and a plurality of three-sided culvert bottom sections each having a pre-stressed bottom slab, a third sidewall and a fourth sidewall arranged such that the third and the fourth sidewalls extend orthogonally from opposite ends of the pre-stressed bottom slab, wherein the pre-stressed bottom slab has a second plurality of steel tendons extending between the opposite ends of the pre-stressed bottom slab and applying a compressive force to the pre-stressed bottom slab, wherein each of the third and the fourth sidewalls has a free end that has at least one male or female connector arranged to mate with the at least one corresponding male or female connector at one of the respective free ends of the first and the second sidewalls, wherein each of the pre-stressed bottom slabs of the plurality of the three-sided culvert bottom sections comprises a plurality of post-tensioning ducts extending from a first side to a second side of each bottom slab, and wherein the plurality of three-sided culvert bottom sections are arranged adjacent to each other such that the second plurality of post-tensioning ducts in each of the pre-stressed bottom slabs are aligned with each other forming a second plurality of continuous channels through the pre-stressed bottom slabs.

14. The pre-stressed concrete box culvert of claim 13, wherein the plurality of three-sided culvert top sections is positioned atop the plurality of three-sided culvert bottom sections such that the pre-stressed top slab of each of the plurality of three-sided culvert top sections is arranged opposite a respective pre-stressed bottom slab of each of the plurality of three-sided culvert bottom sections and wherein the at least one male or female connector of each free end of the first and the second sidewalls of the plurality of three-sided culvert top sections is mated with the at least one corresponding male or female connector of the respective free end of the third and the fourth sidewalls of the plurality of three-sided culvert bottom sections.

15. The pre-stressed concrete box culvert of claim 14, wherein a span between inside faces of each of the first and the second sidewalls is at least 40 feet.

16. The pre-stressed concrete box culvert of claim 14, wherein each joint between adjacent three-sided culvert top sections is positioned such that the joint is approximately aligned with a center of one of the three-sided culvert bottom sections.

17. The pre-stressed concrete box culvert of claim 14, further comprising at least one fastener attached to each three-sided culvert top section and the respective three-sided culvert bottom section such that each three-sided culvert top section and the respective three-sided culvert bottom section are tied together.

18. The pre-stressed concrete box culvert of claim 14, further comprising:

at least one post-tensioning tendon disposed in one of the first plurality of continuous channels through the pre-stressed top slabs; and at least one post-tensioning tendon disposed in one of the second plurality of continuous channels through the pre-stressed bottom slabs.

19. The pre-stressed concrete box culvert of claim 14, further comprising:

a first anchor plate and a second anchor plate each coupled to opposite ends of the at least one post-tensioning tendon disposed in one of the first plurality of continuous channels through the pre-stressed top slabs; and a third anchor plate and a fourth anchor plate each coupled to opposite ends of the at least one post-tensioning tendon disposed in one of the second plurality of continuous channels through the pre-stressed bottom slabs.

* * * * *